US007535448B2

(12) United States Patent
Hiroki

(10) Patent No.: US 7,535,448 B2
(45) Date of Patent: May 19, 2009

(54) LIQUID CRYSTAL DISPLAY DEVICE, AND METHOD OF DRIVING THE SAME

(75) Inventor: Masaaki Hiroki, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 108 days.

(21) Appl. No.: 10/072,171

(22) Filed: Feb. 7, 2002

(65) Prior Publication Data

US 2002/0109659 A1 Aug. 15, 2002

(30) Foreign Application Priority Data

Feb. 8, 2001 (JP) ..... 2001-032543

(51) Int. Cl.
*G09G 3/36* (2006.01)
*G09G 5/10* (2006.01)

(52) U.S. Cl. ..... 345/89; 345/690

(58) Field of Classification Search ..... 345/89, 345/690, 691, 94, 95, 100, 206, 99
See application file for complete search history.

(56) References Cited

U.S. PATENT DOCUMENTS

| | | | | |
|---|---|---|---|---|
| 4,776,676 | A | 10/1988 | Inoue et al. | 350/350 |
| 4,840,462 | A | 6/1989 | Hartmann | 350/350 |
| 4,976,515 | A | 12/1990 | Hartmann | 350/333 |
| 5,214,523 | A | 5/1993 | Nito et al. | |
| 5,349,367 | A | 9/1994 | Wakita | 345/97 |
| 5,400,048 | A | 3/1995 | Shimada et al. | 345/97 |
| 5,471,229 | A | 11/1995 | Okada et al. | |
| 5,594,569 | A | 1/1997 | Konuma et al. | 349/122 |
| 5,598,284 | A | 1/1997 | Kogushi et al. | |
| 5,615,027 | A | 3/1997 | Kuribayashi et al. | 345/87 |
| 5,617,229 | A | 4/1997 | Yamamoto et al. | |
| 5,643,826 | A | 7/1997 | Ohtani et al. | 437/88 |
| 5,657,038 | A | 8/1997 | Okada et al. | 345/94 |
| 5,796,380 | A | 8/1998 | Kurematsu | 345/96 |
| 5,847,799 | A | 12/1998 | Tanaka et al. | 349/174 |
| 5,877,738 | A * | 3/1999 | Ito et al. | 345/94 |
| 5,923,962 | A | 7/1999 | Ohtani et al. | 438/150 |
| 5,953,002 | A * | 9/1999 | Hirai et al. | 345/204 |
| 6,046,790 | A | 4/2000 | Hara et al. | 349/172 |
| 6,057,824 | A * | 5/2000 | Katakura et al. | 345/100 |

(Continued)

FOREIGN PATENT DOCUMENTS

EP 0 816 907 1/1998

(Continued)

OTHER PUBLICATIONS

Pending U.S. Appl. No. 09/570,698 to Yamazaki et al filed May 12, 2000, including specification, claims, abstract, drawings and PTO filing receipt.

(Continued)

*Primary Examiner*—Kevin M Nguyen
(74) *Attorney, Agent, or Firm*—Cook Alex Ltd.

(57) ABSTRACT

In driving a liquid crystal display device, respective voltages of picture signals supplied in subframe periods are changed so as to enlarge a voltage difference between a gradation voltage of a picture signal supplied in the first subframe period and a gradation voltage of a picture signal supplied in the second subframe period.

22 Claims, 12 Drawing Sheets

U.S. PATENT DOCUMENTS

| | | | | |
|---|---|---|---|---|
| 6,069,600 | A | 5/2000 | Saishu et al. | 345/87 |
| 6,069,604 | A | 5/2000 | Verhulst | 345/97 |
| 6,122,034 | A | 9/2000 | Tanaka et al. | 349/174 |
| 6,139,927 | A | 10/2000 | Takao et al. | 428/1.26 |
| 6,163,360 | A | 12/2000 | Tanaka et al. | 349/172 |
| 6,219,019 | B1 | 4/2001 | Hasegawa et al. | 345/96 |
| 6,222,515 | B1 * | 4/2001 | Yamaguchi et al. | 345/89 |
| 6,239,779 | B1 | 5/2001 | Furuya et al. | 345/87 |
| 6,292,183 | B1 | 9/2001 | Yamazaki et al. | 345/211 |
| 6,323,850 | B1 | 11/2001 | Katakura et al. | 345/204 |
| 6,339,416 | B1 | 1/2002 | Kondoh | 345/97 |
| 6,392,624 | B1 | 5/2002 | Yang et al. | 345/94 |
| 6,417,828 | B1 | 7/2002 | Sato et al. | 345/89 |
| 6,545,656 | B1 | 4/2003 | Yamazaki | 345/94 |
| 6,825,826 | B1 * | 11/2004 | Mikami et al. | 345/206 |
| 6,864,874 | B1 * | 3/2005 | Ozawa | 345/99 |
| 6,909,411 | B1 | 6/2005 | Yamazaki et al. | |
| 7,133,015 | B1 * | 11/2006 | Yoshida et al. | 345/99 |
| 7,348,953 | B1 | 3/2008 | Satake | |
| 2005/0206598 | A1 | 9/2005 | Yamazaki et al. | |
| 2006/0267899 | A1 | 11/2006 | Yamazaki | |

FOREIGN PATENT DOCUMENTS

| | | |
|---|---|---|
| JP | 06-194623 | 7/1994 |
| JP | 07-130652 | 5/1995 |
| JP | 09-050050 | 2/1997 |
| JP | 10-073803 | 3/1998 |
| JP | 10-082985 | 3/1998 |
| JP | 10-301091 | 11/1998 |
| JP | 11-231286 | 8/1999 |

OTHER PUBLICATIONS

Yoshida, T. et al, "A Full-Color Thresholdless Antiferroelectric LCD Exhibiting Wide Viewing Angle with Fast Response Time," SID 97 Digest, pp. 841-844, (1997).

Furue, H. et al, "Characteristics and Driving Scheme of Polymer-Stabilized Monostable FLCD Exhibiting Fast Response Time and High Contrast Ratio with Gray-Scale Capability," SID 98 Digest, pp. 782-785, (1998).

Chandani, A.D.L et al, "Effect of Alignment Layer on V-Shaped Switching in a Chiral Smectic Liquid Crystal," Liquid Crystals, vol. 25, No. 0,000-000, LCT 100975, pp. 1-13, (1998).

* cited by examiner

. Semiconductor Layer
: Gate Metal (1st & 2nd Conductive Layers)
: Wiring
Lower Light Shielding Film
: Contact Hole (Lower Light Shielding Film – Gate Metal)
: Contact Hole (Semiconductor Layer– Gate Metal –Wiring)
: Contact Hole (Wiring– Pixel Electrode)

LIQUID CRYSTAL DISPLAY DEVICE, AND METHOD OF DRIVING THE SAME

BACKGROUND OF THE INVENTION

1. Field of the Invention

The present invention relates to a liquid crystal display device having a circuit composed of a thin film transistor, which may be referred to as a TFT hereinafter, and a method of driving the same. The present invention relates to, for example, an electro-optical device, a typical example of which is a liquid crystal display panel, and an electronic instrument on which such an electro-optical device is mounted as a component.

2. Description of Related Art

In recent years, attention has been paid to the technique of using a semiconductor thin film (thickness: about several nanometers to several hundreds of nanometers) formed on a substrate having an insulated surface to make thin film transistors (TFTs). A thin film transistor is widely applied to electronic devices such as an IC and an electro-optical device. It is particularly desired to develop the thin film transistor as a switch element of a liquid crystal display device.

In an active matrix type liquid crystal display device, its pixel portion is composed of several tens of pixels to millions of pixels which are arranged in a matrix form. Pixel TFTs are arranged in the respective pixels, and charges which go into and out from pixel electrodes connected to the respective pixel TFTs are controlled by the switch function of the pixel TFTs.

Recently, an active matrix type liquid crystal display device has been spreading not only as a display of a notebook-size personal computer, which has been widely known up to now, but also as a display of a desktop personal computer.

In a personal computer, it is desired to display plural pieces of information (including character information and image information) at a time. Thus, the display ability of the personal computer has been improved. That is, the resolution of images has been made high and the gradation number of display has been made large. (It is also desired to attain full-color display.)

With such an improvement in the display ability of a personal computer, an improvement in an active matrix type liquid crystal display device as the display device thereof has been advanced. Thus, in recent years, attention has been paid to an active matrix type liquid crystal display device in a digital driving mode which is easily interfaced with a personal computer, makes high-speed driving of its driver possible, and can realize an improvement in the display ability thereof.

In recent years, it has been increasingly desired to make the gradation number of an active matrix type liquid crystal display device larger. As one of the means for this, there has been developed an active matrix type liquid crystal display device in a digital driving mode having a driving circuit of a digital-input/analog-output type.

Into an active matrix type liquid crystal display device in a digital driving mode, digital video data are inputted from a data source of a personal computer or the like. An active matrix type liquid crystal display device having a digital driver needs a D/A converter circuit, which may be referred to as a digital-analog converter (DAC), for converting digital video data inputted from the outside to analog data (gradation voltages). The D/A converter circuit can be classified into various types.

One of the characteristics of an active matrix type liquid crystal display device having a digital driver is that pixels corresponding to one line can be simultaneously driven, that is, the so-called line-successive driving can be relatively easily realized.

In an analog driving mode, limitless gradation can be displayed. In a digital driving mode, however, the gradation (or the gradation number) which a display device realizes corresponds to a bit number. The gradation (or the gradation number) is the number of steps of brightness which can be represented.

The following will describe a conventional driving method. FIG. 12 is a driving timing chart of a conventional liquid crystal display device.

Display of one screen is referred to as "one frame (Tf)", and a time necessary for displaying the one frame is referred to as "one frame period" hereinafter.

First, display in the first frame period will be described. About the first frame, a picture signal $D_1$ is supplied to the corresponding pixel TFT so as to display an image.

About display in the next frame period, a picture signal $D_2$ is supplied to the corresponding pixel TFT in the same way as in the first frame period, so as to display an image.

Thereafter, display of continuous frames is performed in the same way, so as to form a picture. Hitherto, 60 frames have been displayed per second. Therefore, the time for writing picture signals in the pixels is long so that flicker is generated to be conspicuous.

When gradation display is performed, there arises a problem that afterimages are liable to stand out because of a long response time of liquid crystal. Particularly in the case that moving images are displayed. afterimages cause a big problem.

SUMMARY OF THE INVENTION

In light of the above-mentioned problems, an object of the present invention is to provide a liquid crystal display device making it possible to reduce flicker and afterimages and display highly minute pictures.

The driving method of the present invention is a method of driving a liquid crystal display device comprising plural pixels, a driving circuit for supplying picture signals to the pixels, and a liquid crystal whose transmittivity is changed dependently on the voltage of the picture signals supplied to the pixels, wherein each of frames is divided to plural subframes, respective voltages of picture signals supplied in plural subframe periods are changed to enlarge the following: a voltage difference between the first picture signal supplied to the pixels in at least one of the subframe periods and the second picture signal supplied to the pixels in the subframe period adjacent, on the basis of time, to the above-mentioned subframe period, and the subframes are displayed successively on the basis of time, so as to display one frame.

The liquid crystal display device for carrying out the above-mentioned driving method is a liquid crystal display device comprising plural pixels, a driving circuit for supplying picture signals to the pixels, and a liquid crystal whose transmittivity is changed dependently on the voltage of the picture signals supplied to the pixels, further comprising a means for dividing each of frames to plural subframes, and dividing picture signals supplied in each of frame periods to picture signals supplied in plural subframe periods, a means for changing respective voltages of picture signals supplied in plural subframe periods to enlarge the following: a voltage difference between the first picture signal supplied to the pixels in at least one of the subframe periods and the second picture signal supplied to the pixels in the subframe period adjacent, on the basis of time, to the above-mentioned subframe period, and a means for displaying the subframes successively on the basis of time, so as to display one frame.

In the case that each of frames is divided to two subframes, the driving method of the present invention is a method of driving a liquid crystal display device comprising plural pixels, a driving circuit for supplying picture signals to the pixels, and a liquid crystal whose transmittivity is changed dependently on the voltage of the picture signals supplied to the pixels, wherein each of frames is divided to two subframes, respective voltages of picture signals supplied in two subframe periods are changed to enlarge the following: a voltage difference between the first picture signal supplied to the pixels in one of the subframe periods and the second picture signal supplied to the pixels in the other of the subframe periods, and the two subframes are displayed successively on the basis of time, so as to display one frame.

In the above-mentioned driving method, the period for each of the frames is 1/60 second. In this case, the subframe period is 1/120 second.

The liquid crystal display device for carrying out the above-mentioned driving method is a liquid crystal display device comprising plural pixels, a driving circuit for supplying picture signals to the pixels, and a liquid crystal whose transmittivity is changed dependently on the voltage of the picture signals supplied to the pixels, further comprising a means for dividing each of frames to two subframes, and dividing picture signals supplied in each of frame periods to picture signals supplied in two subframe periods, a means for changing respective voltages of picture signals supplied in two subframe periods to enlarge the following: a voltage difference between a picture signal supplied to the pixels in one of the subframe periods and a picture signal supplied to the pixels in the other of the subframe periods, and a means for displaying the two subframes successively on the basis of time to display one frame.

In the respective driving methods, each of the frame periods is not limited to 1/60 second. This period is, for example, 1/24 second, 1/48 second, or 1/96 second.

PREFERRED EMBODIMENTS OF THE INVENTION

Embodiments of the present invention will be described hereinafter.

In the liquid crystal of the present invention, the display of one frame is performed by displaying plural subframes at a high speed.

In the description on the present invention, display of one frame is referred to as "one frame". "Subframes" are produced by dividing one frame corresponding to one time axis into pieces corresponding to plural time-axes. A time necessary for displaying one frame is referred to as "one frame period (Tf)", and each of periods obtained by dividing the one frame (Tf) into plural pieces is referred to as a "subframe period (Tsf)".

Hitherto, a picture signal is supplied to each pixel in one frame period to display an image. For example, the display of 60 frames is performed per second. On the other hand, in the present invention, a picture signal is supplied plural times to each pixel in one frame period to display an image. For example, the display of 120 subframes is performed per second to display half-tone correctly.

Figure 1:
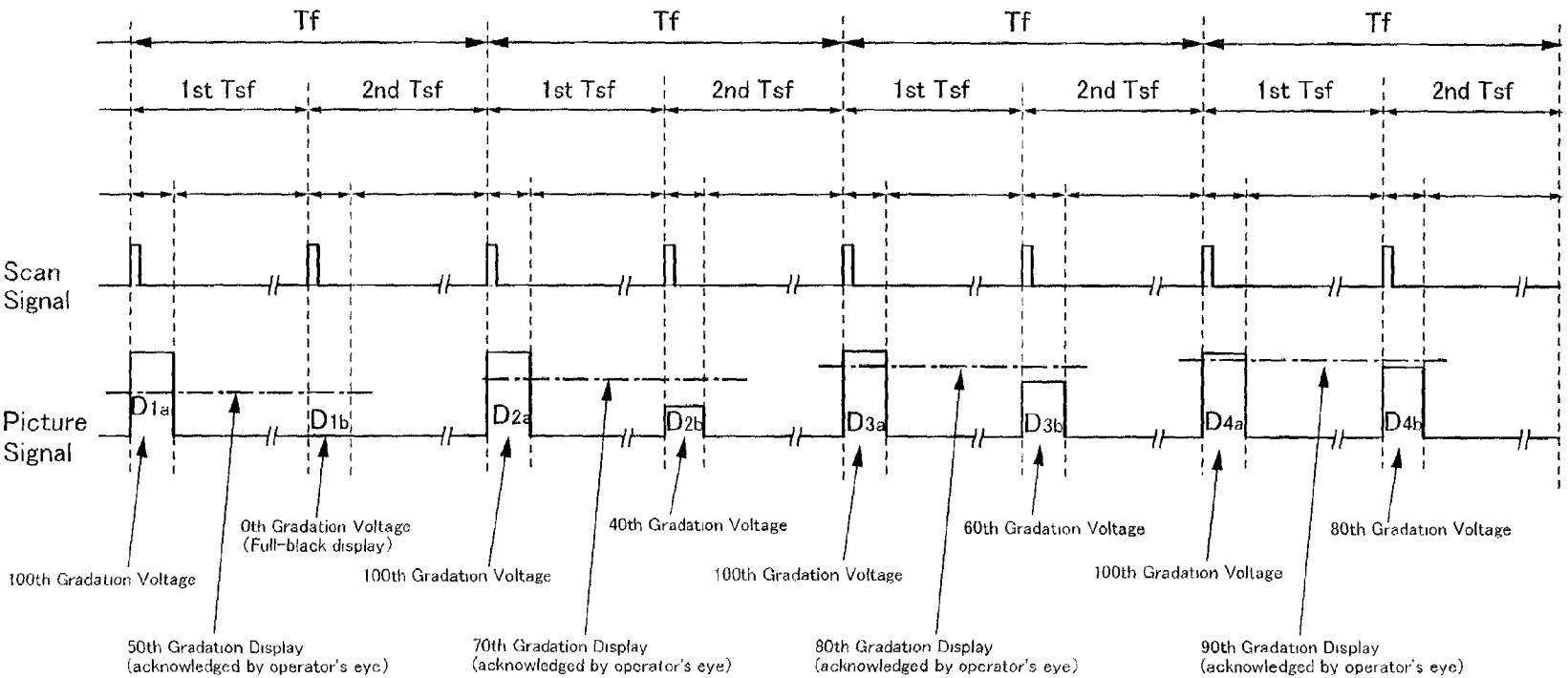
FIG. 1 is a timing chart according to the present invention.

FIG. 1 is an example of a timing chart according to the present invention.

The example shown in FIG. 1 is concerned with an example wherein each frame is composed of two subframes, that is, the first subframe and the second subframe. Since one frame is divided to two subframes in this example, each subframe period is the half of one frame period (that is, 1/120 second).

First, the display of an initial frame period will be described. In the first subframe period, the first picture signal is supplied to the corresponding pixel TFT to display an image. In the first subframe period, the first picture signal is successively supplied to each of the pixels. Next, the second picture signal is supplied to the corresponding pixel TFT in the second subframe period. In the same way, the second picture signal is successively supplied to each of the pixels in the second subframe period.

In the case that one frame is composed of two subframes in this way and the same liquid crystal material as in the prior art, through which a picture signal is supplied one time to each pixel in one frame period (ordinary frame driving), is used, even if picture signals having the same gradation voltage are supplied to the two subframes, no change in an afterimage phenomenon is caused because the respond speed itself of the liquid crystal does not change. As a result, an effect for reducing afterimages is not produced. It is particularly difficult to represent half-tone causing no afterimage or reduced afterimages. In order to solve this problem about the response speed of the liquid crystal, for example, a reset signal should be supplied to one of the two subframes to perform black-display instantaneously in the whole screen.

However, when the reset signal is supplied to one of the two subframes to perform black-display in the whole screen, the black-display in the whole screen and gradation-display based on a picture signal into the other subframe are combined with each other through watchers' eyes. As a result, the gradation of each frame becomes lower than the gradation based on the picture signal into the other subframe. Since each subframe period is very short, a gradation change in each subframe period cannot be recognized through watchers' eyes. Thus, the combined gradations are recognized. This phenomenon does not bring a problem very much for a low-gradation voltage area (dark display area). However, the gradation of the entire display drops in areas other than the low-gradation voltage area, that is, a middle-gradation voltage area (half-tone display area) and a high-gradation voltage area (bright display area).

Thus, in the present invention, each of picture signals supplied to subframe periods is transformed to enlarge a difference between the gradation voltage of a picture signal supplied to the first subframe and the gradation voltage of a picture signal supplied to the second subframe. thereby supplying the picture signals continuously to pixels.

According to the present invention, in a low-gradation voltage area (dark display area) in a picture screen, a supplied picture signal is transformed in one of two subframes for performing display in the screen to enlarge a difference between the voltage of the picture signal and the voltage of a reset signal supplied to the other subframe. When the reset signal is supplied to the other subframe, black-display in the whole screen is instantaneously performed. Hitherto, displays of two subframes have been combined with each other by this reset signal, so as to result in a drop in gradation. According to the present invention, however, a drop in gradation can be prevented since the picture signal having the transformed gradation voltage is supplied to the one of the subframes.

The above-mentioned matter will be specifically described, referring to FIG. 1. When an operator wants to display a 50th gradation, by applying a voltage for a 100th gradation to the first subframe and applying a voltage for a 0th gradation to the second subframe, the display of a 50th gradation, which results from the combination of the voltages applied to the first and second subframes, can be recognized through the operator's eyes.

Furthermore, according to the present invention, in areas other than the low-gradation voltage area of the picture screen, no reset signal is supplied to the one of the subframes. According to the present invention, no reset signal is supplied to the one subframe, but both of the gradation voltages of picture signals supplied to the two subframes are transformed to enlarge a difference between the two gradation voltages. In the present invention, it is important to set the two gradation voltages to display a desired gradation in such a manner that the two gradation voltages are combined with each other. By supplying the two picture signals continuously to the pixels in this way, the fact that the combined gradation displays are instantaneously recognized through the operator's eyes is used to give one frame having a desired gradation display.

In the present invention, adopted is not the method of merely preparing picture signals by the number of the subframes (i.e. preparing picture signals corresponding to the number of the subframe) so as to supply the picture signals to the pixels at a high speed, but individual picture signals are transformed in such a manner that the liquid crystal is driven at a high speed. In other words, in an example wherein one frame is divided into two subframes, adopted is not the method of applying a 70th gradation voltage to the first subframe and then applying a 70th gradation voltage continuously to the second subframe so as to perform display, but a difference between a gradation voltage applied to the first subframe and a gradation voltage applied to the second subframe is made large to raise the reaction rate of the liquid crystal.

The above-mentioned matter will be specifically described, referring to FIG. 1. When an operator wants to display the 70th gradation, by applying a voltage for the 100th gradation to the first subframe and applying a voltage for the 40th gradation to the second subframe, the display of the 70th gradation, which results from the combination of the voltages applied to the first and second subframes, can be recognized through the operator's eyes. When the operator wants to display a 80th gradation, a voltage for a 100th gradation and a voltage for a 60th gradation should be applied to the first subframe and the second subframe, respectively. When the operator wants to display a 90th gradation, a voltage for a 100th gradation and a voltage for a 80th gradation should be applied to the first subframe and the second subframe, respectively.

The gradations used in the description with reference to FIG. 1. for example, the 100th gradation and the 50th gradation, are mere examples for simplifying the description. Thus, Gradation which can be represented is not limited.

In order to intensify the respond speed of the liquid crystal, it is advisable to enlarge a difference between gradation voltages applied to the subframes adjacent to each other along the time axis.

Polarity reversion is performed, the state of which is not illustrated, in order not to cause the baking of the liquid crystal.

When moving images are displayed, plural displays are continuously performed in a short time. As a result, the moving images can be smoothly displayed and afterimages can be reduced. For this reason, the present invention is very effective particularly for this case.

The above description is concerned with the example wherein one frame is divided to two subframes. Needless to say, however, the present invention is not limited to this example. In the case that one frame is divided into n subframe wherein n is a natural number, first to $n^{th}$ picture signals are supplied to the corresponding pixel TFTs in the same way in the first subframe period to the $n^{th}$ subframe period.

Display of 60 frames per second is based on the standard corresponding to televisions. According to the standard corresponding to the movies, display of 24 frames per second, display of 48 frames per second and display of 96 frames per second are used. Of course, the present invention can be applied to the standard corresponding to the movies.

The present invention having the above-mentioned structure will be described in more detail by way of the following Examples.

EXAMPLES

Example 1

Figure 2:
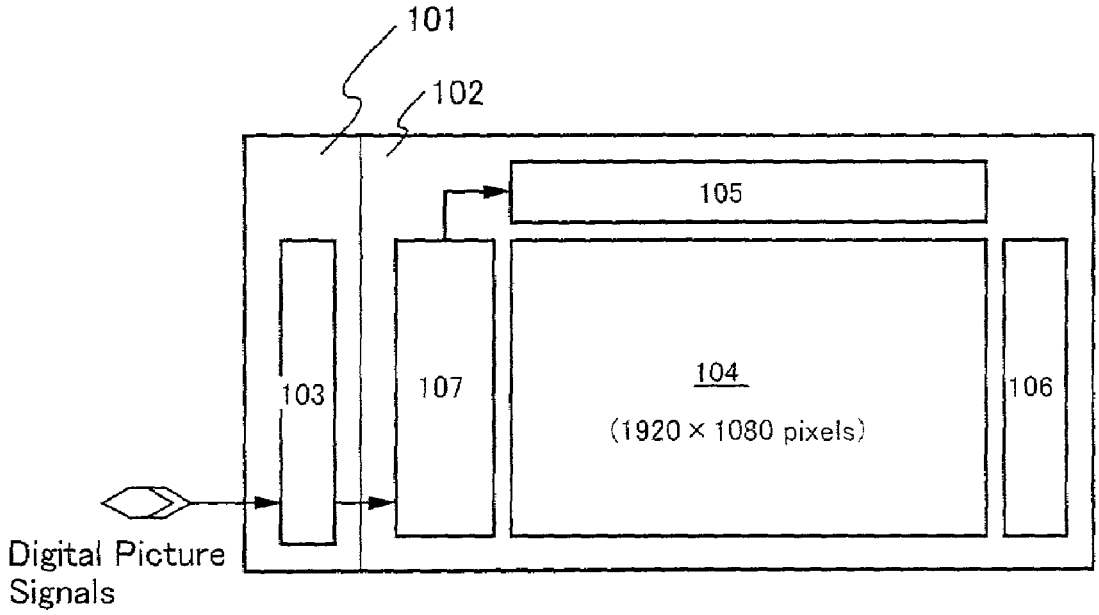
FIG. 2 is a block diagram of a liquid crystal display device.

FIG. 2 schematically illustrates a configuration of the liquid crystal display device of the present invention. This liquid crystal display device has, on an active matrix substrate 101, a source driver 105, a gate driver 106, a digital video data dividing circuit 107, a pixel portion 104 in which plural pixel TFTs are arranged in a matrix form, and a flexible print circuit (FPC) terminal 103. In the liquid crystal display device, this active matrix substrate 101 and a counter substrate 102 are attached to each other with an adhesive agent such as a sealant, and a liquid crystal is held therebetween. The source driver 105 and the gate driver 106 drive the pixel TFTs in the pixel portion. The counter substrate 102 has a counter electrode (not illustrated). Various signals are inputted from the outside to the FPC terminal 103.

Figure 3:
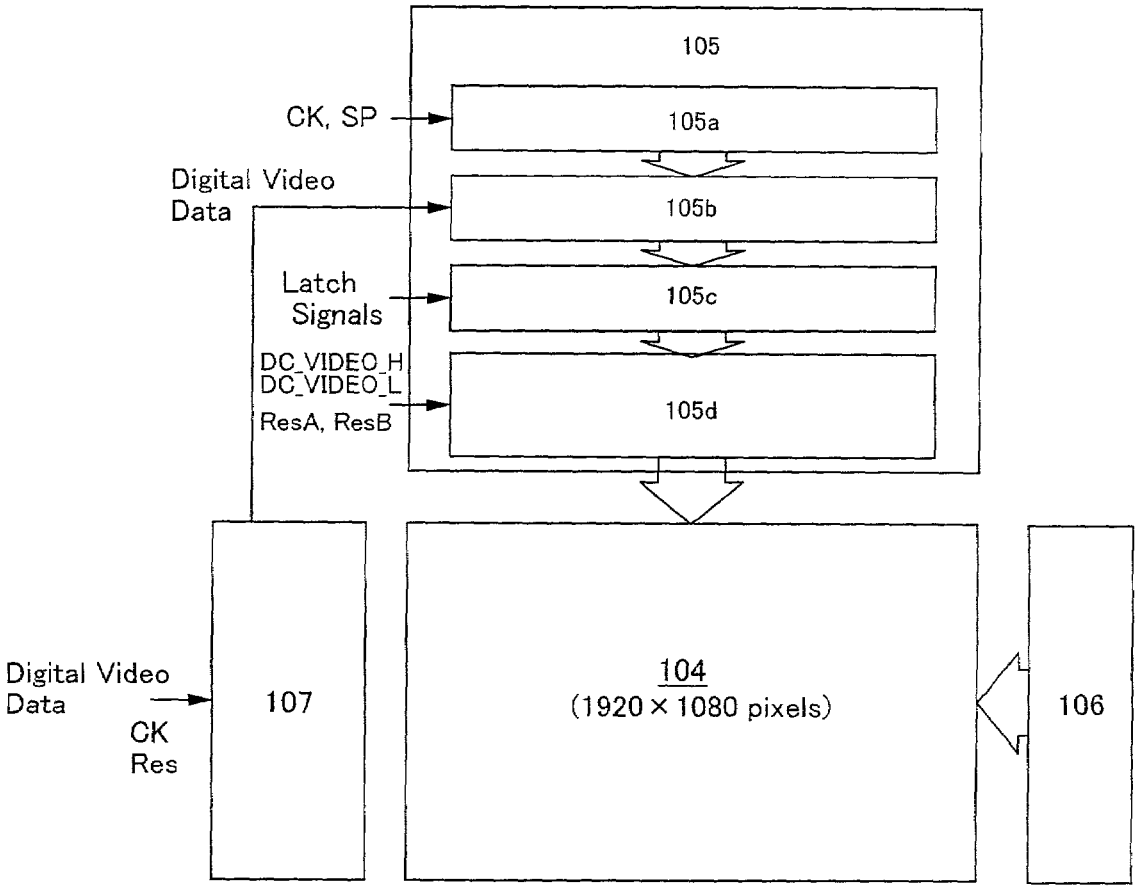
FIG. 3 is a block diagram of the periphery of a pixel portion.

FIG. 3 illustrates the configuration of the source driver of the liquid crystal display device of the present example in more detail, in which the same reference numbers are attached to elements corresponding to the elements in FIG. 1. In FIG. 3, reference numbers 105, 106, 104, and 107 represent the source driver, the gate driver, the pixel portion, and the digital video data dividing circuit (i.e., serial-to-parallel conversion circuit: SPC), respectively.

The source driver 105 has a shift register circuit (240 stages×2 shift register circuits) 105*a*, a latch circuit 1 (960×8 digital latch circuits) 105*b*, a latch circuit 2 (960×8 digital latch circuits) 105*c*, and a D/A converter circuit (240 DACs) 105*d*. The source driver 105 further has buffer circuits and level shift circuits (not illustrated). For convenience of the description, the D/A circuit 105*d* includes the level shift circuits.

The gate driver 106 has shift register circuits and buffer circuits. level shift circuits, and so on (not illustrated).

The pixel portion 104 has 1920 (in the width direction)× 1080 (in the length direction) pixels. In each of the pixels, the pixel TFT is arranged. A source signal line is electrically connected to the source region of each of the pixel TFTs, and a gate signal line is electrically connected to the gate signal line thereof. Furthermore, a pixel electrode is electrically connected to the drain region of each of the pixel TFTs. Each of the pixel TFTs controls the supply of picture signals (gradation voltages) to the pixel electrode electrically connected to the pixel TFT. Picture signals (gradation voltages) are supplied to each of the pixel electrodes, and the voltages are applied to the liquid crystal sandwiched between the each of the pixel electrodes and the counter electrode.

The following will describe the operation of the active matrix type liquid crystal display device of the present example, and the flow of signals.

First, the operation of the source driver will be described. Clock signals (CK) and a start pulse (SP) are inputted to the shift register circuit 105*a*. On the basis of the clock signals (CK) and the start pulse (SP), timing signals are successively generated in the shift register circuit 105*a*, and then the timing signals are successively supplied, through buffer circuits and so on (not illustrated), to circuits at subsequent steps.

The timing signals from the shift register circuit 105*a* are buffered by the buffer circuits and so on. Since a large number of circuits and elements are connected to the source signal line to which the timing signals are supplied, the source signal line has a large load capacitance (parasite capacitance). In order to prevent "bluntness" of the rise of the timing signals, resulting from the large load capacitance, the buffer circuits are set up.

The timing signals buffered by the buffer circuits are supplied to the latch circuit 1 (105*b*). The latch circuit 1 (105*b*) has 960 stages of latch circuits for processing 8-bit digital video data. When the timing signals are inputted to the latch circuit 1 (105*b*), 8-bit digital video data supplied from the digital video data dividing circuit 107 are successively taken and held in the latch circuit 1 (105*b*).

A time from the start of the writing of the digital video data in the latch circuits at all the stages in the latch circuit 1 (105*b*) to the finish thereof is called a line period. A subframe line period is a time interval from the start of the writing of the digital video data in the latch circuit at the leftmost stage in the latch circuit 1 (105*b*) to the finish of the writing of the digital video data in the latch circuit at the rightmost stage therein. Actually, the above-mentioned subframe line period to Which a horizontal retrace line period is added may be called a subframe line period.

After the finish of one subframe period, a latch signal is supplied to the latch circuit 2 (105*c*) in synchronization with the operation timing of the shift register circuit 105*a*. In this instant, the digital video data written and held in the latch circuit 1 (105*b*) are, all at once, sent to the latch circuit 2 (105*c*) and then written and held in the latch circuits at all the stages in the latch circuit 2 (105*c*).

In the latch circuit 1 (105*b*) wherein the sending-out of the digital video data to the latch circuit 2 (105*c*) has been finished, digital video data supplied from the digital video data dividing circuit are successively written again on the basis of timing signals from the shift register circuit 105*a*.

In the second line period, the digital video data written and held in the latch circuit 2 (105*c*) are supplied to the D/A converter circuit 105*d*.

Figure 4:
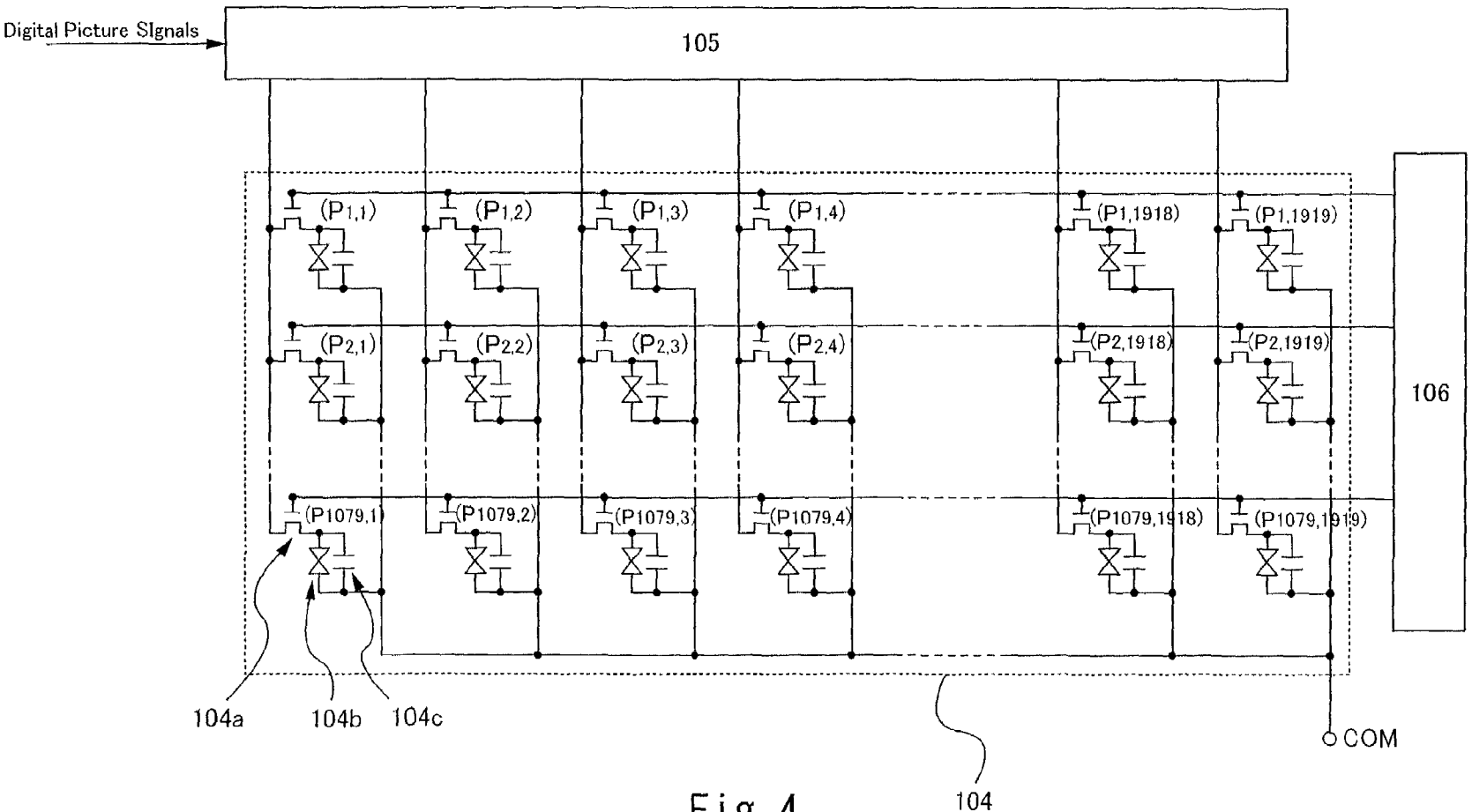
FIG. 4 is a view illustrating the pixel portion.

Referring to FIG. 4, the circuit configuration of the liquid crystal display device of the present example, particularly the configuration of the pixel portion thereof, will be described.

In the present example, the pixel portion 104 has 1920× 1080 pixels. For convenience of the description, symbols P1,1, P2,1, . . . P1079,1919 are attached to the respective pixels. Each of the pixels has a pixel TFT 104*a* and a retaining capacitor 104*c*. A liquid crystal 104*b* is sandwiched between the active matrix substrate and the counter substrate. The liquid crystal 104*b* is a schematically-illustrated liquid crystal corresponding to each of the pixels. Symbol "COM" represents a common voltage terminal, and this is connected to one terminal of each of the counter electrodes and one terminal of each of the retaining capacitors.

In the liquid crystal display device of the present example, the pixels corresponding to one line (for example, P1,1, P1,2 . . . , and P1,1919) are simultaneously driven, that is, line-successive driving is performed. In other words, picture signals are simultaneously written in all the pixels corresponding to one line.

The following will describe the display method of the liquid crystal of the present example, referring to FIG. 1. FIG. 1 is a driving timing chart of the liquid crystal display device of the present example. In the liquid crystal display device of the present example, one frame is composed of two subframes. One frame period (Tf) is composed of the first subframe period (1st Tsf) and the second subframe period (2nd Tsf).

First, display in the first frame period will be described. In the first subframe period (1st Tsf), scanning signals are inputted to the gate driver. In this period, digital data in the pixels P1,1 to P1,1979 are converted to first digital signals $D_{1a}$ by the D/A converter circuit and then the signals $D_{1a}$ are successively written in the respective pixels to perform display. When the first picture signals $D_{1a}$ are written in the pixels P1079,1 to P1079,1979, which correspond to the last line, the first display finishes. In this way, the first subframe period finishes.

Next, the second subframe period (2nd Tsf) starts. In the second subframe period (2nd Tsf), scanning signals are inputted to the gate driver. Thus, in the second subframe period (2nd Tsf), second picture signals $D_{1b}$ resulting from the conversion of digital video data in the pixels P1,1 to P1,1979 by the D/A converter circuit are successively written in the respective pixels to perform display. When the second picture signals $D_{1b}$ are written in the pixels P1079,1 to P1079,1979 corresponding to the last one line, the second display is finished. In this way, the second subframe period is over.

The first display and the second display require only a very short time. Accordingly, the two screens displayed in the two subframe periods are combined with each other and the resultant picture is recognized with watchers' eyes. Thus, a display having gradation resulting from the combination of the first display and the second display is recognized with the watchers' eyes.

In the next frame period, first picture signals $D_{2a}$ are supplied to the corresponding pixel TFTs in the first subframe period (1st Tsf), in the same way as in the first frame period, so as to perform the first display. Next, in the second subframe period, second picture signals $D_{2b}$ are supplied to the corresponding picture signals to perform the second display.

In the same way, displays of continuous frames are performed to form images. In the same way, the first display and the second display are continuously performed in a very short time, such as this subframe period, to give a display based on the combination of the two displays.

In the above-mentioned example of the present invention, a difference is enlarged between the gradation voltage of the picture signals of one out of two subframes constituting one frame and the voltage of the picture signals of the other, so that two displays in the two subframe periods are actually combined. In this way, a desired gradation display can be obtained.

Example 2

In the present example, a structural example of the liquid crystal module to which the driving method of the present invention is applied will be described, referring to FIGS. 5-7.

Figure 5:
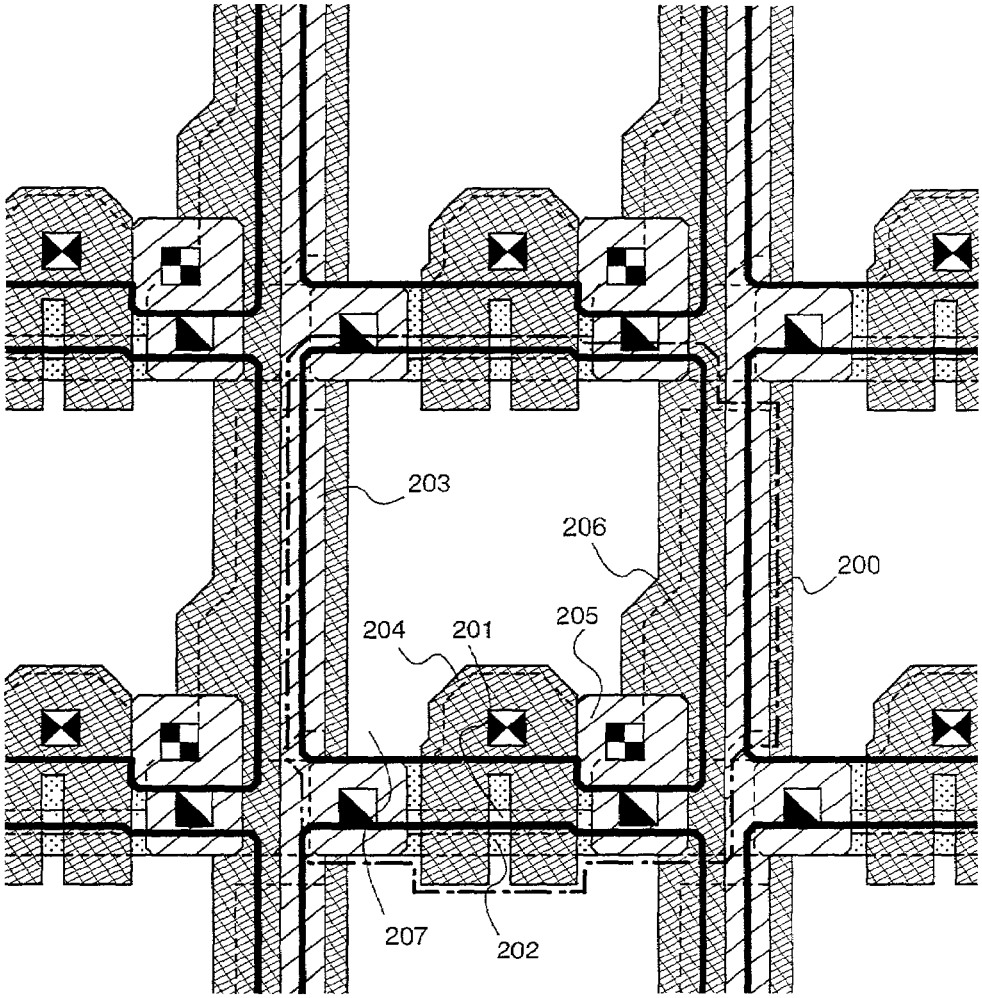
FIG. 5 is a view illustrating the configuration of a pixel portion.
Figure 6A:
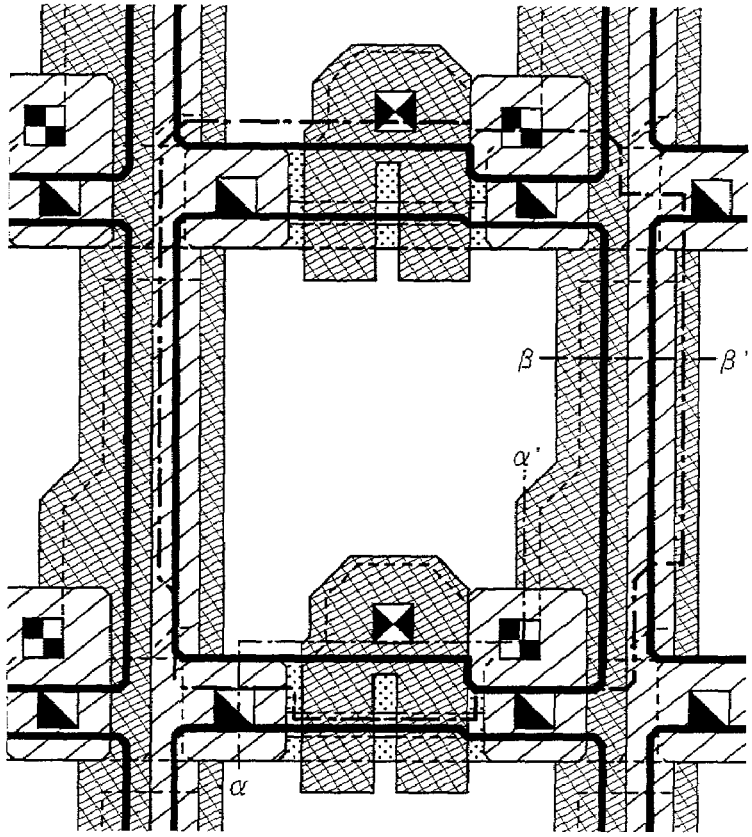
FIGS. 6A and 6B are views illustrating the configuration of the pixel portion.
Figure 6B:
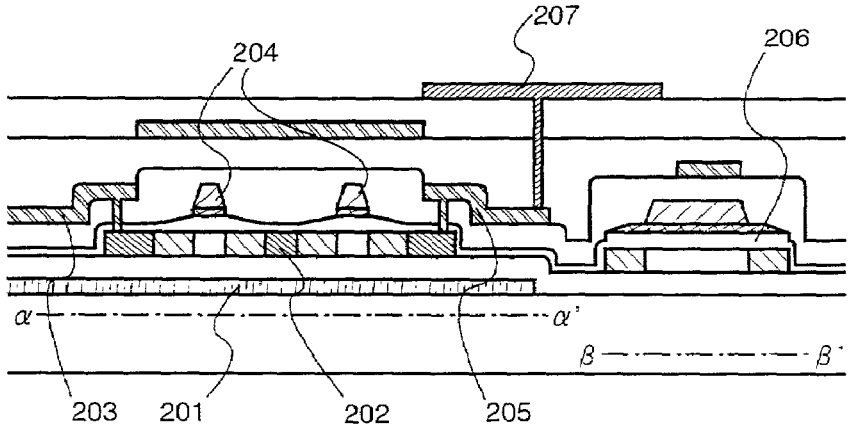

FIG. 5 illustrates a top view of a pixel portion in the present example, wherein illustration of the side of a counter substrate is omitted. A portion surrounded by a dot line frame 200 represents one pixel portional views of portions shown by dot lines α-α' and β-β' in FIG. 6A are illustrated by dot lines α-α' and β-β' in FIG. 6B. Each pixel has a semiconductor layer 201, a lower light-shielding film 202, a source signal line 203, a gate electrode 204 and a connecting electrode 205, a retaining capacitor 206 and a pixel electrode 207. The retaining capacitor of the pixel is formed between a semiconductor layer connected electrically to the semiconductor layer of the pixel TFT and an interconnection formed in the same layer as the gate electrode.

When the pixel portion is formed, it is desired to make the numerical aperture thereof high. Thus, in the present example, the lower light-shielding film 202 also functions as a gate signal line. The source signal line is arranged to overlap with the retaining capacitor.

Figure 7A:
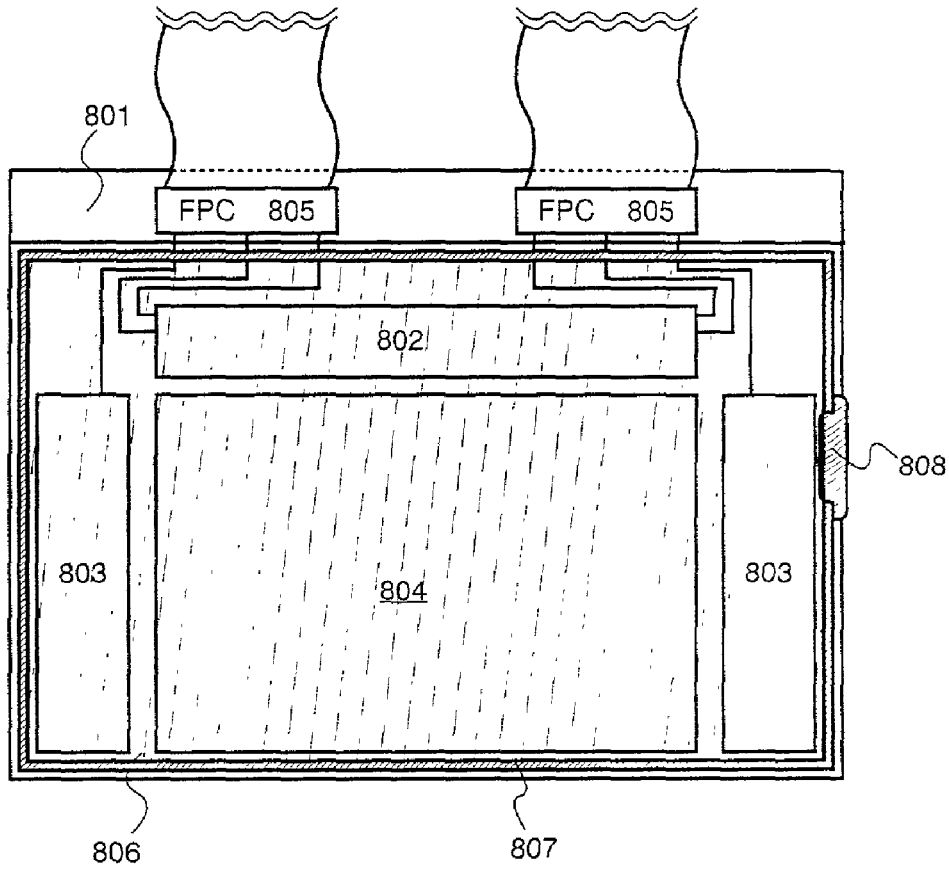
FIGS. 7A and 7B are a schematic diagram of the whole of a liquid crystal module, and a sectional view thereof.
Figure 7B:
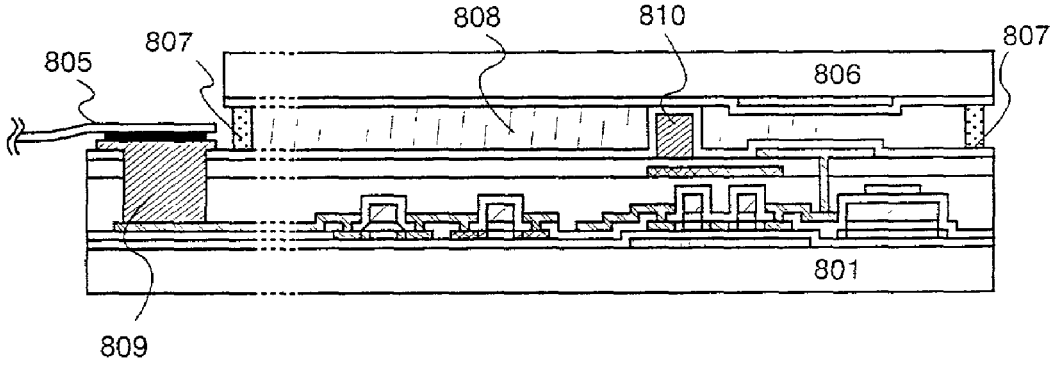

FIG. 7 illustrates an example of a liquid crystal module using an active matrix substrate. FIG. 7A and FIG. 7B are a top view, and a sectional view, respectively. A pixel portion 804 is arranged at the center of a substrate 801. At the upper side of the substrate 804, a source signal line driving circuit 802 for driving a source signal line is arranged. At the right and left sides of the pixel portion 804, gate signal line driving circuits 803 for driving a gate signal line is arranged. In the present example, the gate signal line driving circuits 803 are symmetrically arranged at the right and left sides of the pixel portion. However, only one gate signal line driving circuit 803 may be arranged at one side. In short, a designer should select either thereof, considering the substrate size of the liquid crystal module, and so on. However, the bilateral-symmetrical arrangement shown in FIG. 7A is preferred from the viewpoint of the operation reliability and the driving efficiency of the circuit. Signals are inputted from a flexible print circuit (FPC) 805 to the respective driving circuits. Contact holes are made in an interlayer insulating film and a resin film so as to reach interconnections arranged in given positions of the substrate 801, and a connecting electrode 809 is arranged. Thereafter, the FPC 805 is pressed and adhered, through an anisotropic conductive film and so on, to the substrate 801. In the present example, ITO is used to form the connecting electrode at the same time when a pixel electrode is formed.

A sealing agent 807 is applied, along the outer circumference of the substrate 801, to the periphery of the driving circuit and the pixel portion. In the state that a given gap (interval between the substrate 801 and a counter substrate 806) is kept by means of a spacer 810 made, in advance, on the active matrix substrate, the counter substrate 806 is attached to the substrate 801. Thereafter, a liquid crystal 800 is injected thereto from a portion to which the sealing agent 808 is not applied. The space in which the liquid crystal is injected is airtightly sealed with a sealant 808. By the above-mentioned steps, a liquid crystal module is completed.

In the present example, all the driving circuits are formed on the substrate. However, several ICs may be used as a part of the driving circuits.

The present example may be combined with Example 1. In this case, the pixel portion 804 in the present example corresponds to the pixel portion 104 in Example 1. The source signal line driving circuit 802 and the gate signal line driving circuit 803 in the present example correspond to the source driver 105 and the gate driver 106 in Example 1, respectively.

Example 3

In the present example, an example wherein the liquid crystal module of Example 2 is applied to a view finder for a video camera will be described.

Figure 8:
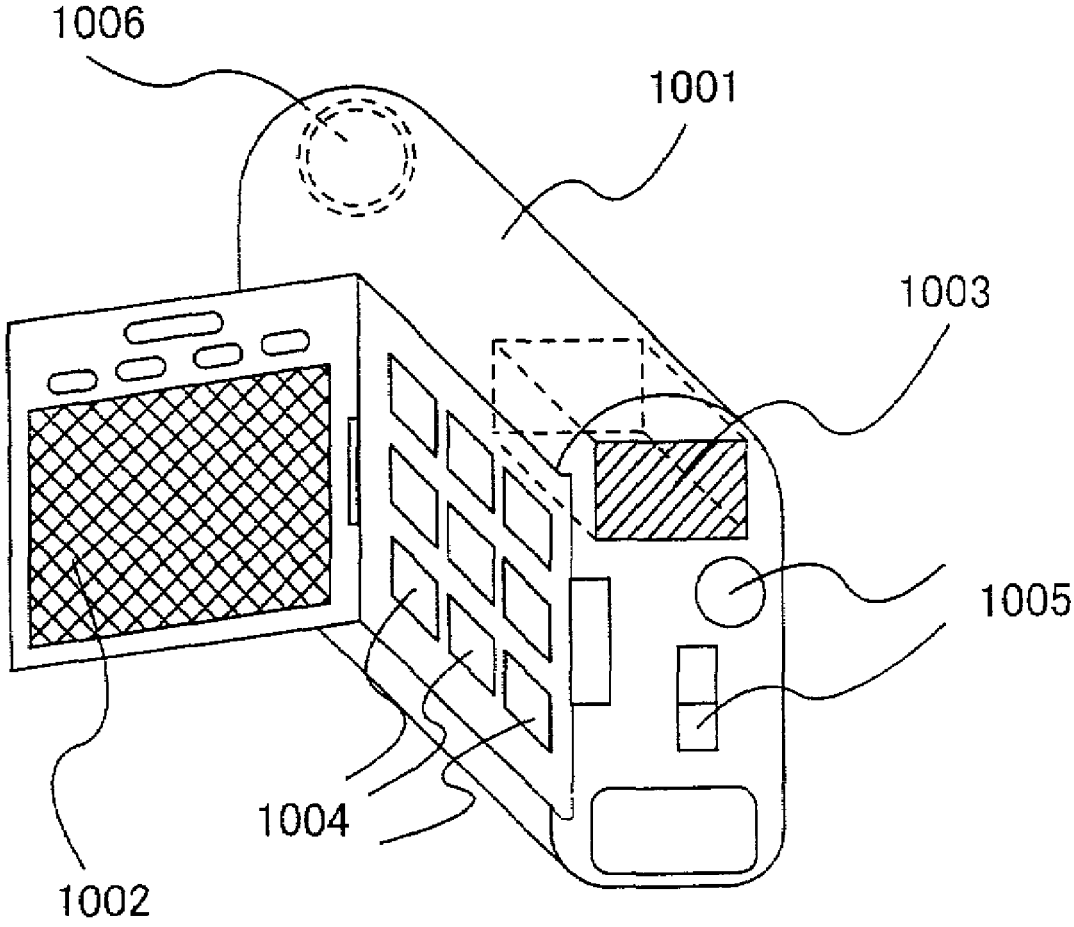
FIG. 8 is a view of the external appearance of a video camera.

In FIG. 8, reference number 1001 represents a video camera body; reference number 1002, a liquid crystal panel; reference number 1003, a view finder; reference numbers 1004 and 1005, operation switches; and reference number 1006, a lens. In the video camera illustrated in FIG. 8, pictures taken in from the lens 1006 are converted to picture signals by CCD imaging elements, and then the picture signals are recorded on a recording medium. The liquid crystal panel 1002 and the view finder 1003 are display devices for displaying the picture signals.

While an operator observes pictures displayed on the view finder 1003, the operator can take images of an object. The view finder 1003 has a small-sized liquid crystal module, and the operator can observe pictures displayed on this small-sized liquid crystal module.

Since pictures on the view finder 1003 which the operator observes in the video camera are pictures on the liquid crystal module to which the present invention is applied, the pictures have very high resolution and reduced afterimages and flickers even if the pictures are small. Therefore, the operator can easily take images of an object while the operator observes pictures on the view finder 1003.

The liquid crystal panel 1002 is mounted externally onto this video camera. The size of this externally-mounted liquid crystal panel 1002 is from about 2 to 4 inches, and is relatively larger as compared with pictures observed on the view finder 1003. The present invention can also be applied to this liquid crystal panel 1002. If the present invention is applied to the liquid crystal panel 1002, the operator can easily take images of an object or reproduce recorded pictures while the operator observes pictures displayed on the externally-mounted liquid crystal panel. This externally-mounted liquid crystal panel may not be set up when importance is attached to power consumption, use in the field, and portability.

The present example is concerned with the small-sized video camera illustrated in FIG. 8, however, the present invention may be unrestrictedly applied to various instruments, for example, a view finder of a television camera.

Also, the present example may be combined with Example 1.

Example 4

A driving circuit or a pixel portion formed according to the present invention can be used in various modules (such as active matrix type liquid crystal modules and active matrix type EC modules). In other words, the present invention can be applied to all of electronic instruments having a display section to which any one of these modules is fitted.

Examples of such electronic instruments include a video camera, a digital camera, a head mount display (goggle-type display), a car navigation system, a projector, a car stereo, a personal computer, and portable data terminals (such as a mobile computer, a portable telephone and an electronic book). One example is shown in FIGS. 9A-9F, 10A-10D and 11A-11C.

Figure 9A:
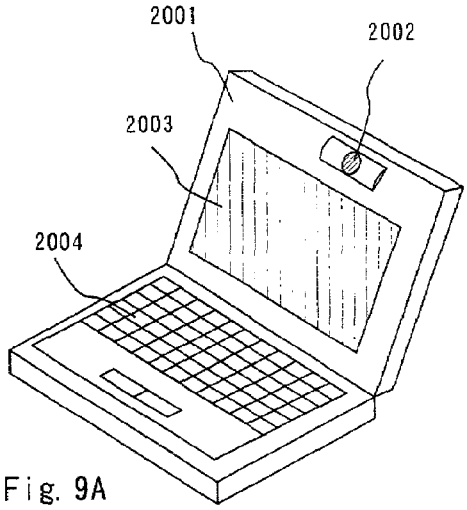
FIGS. 9A to 9F are views illustrating examples of an electronic instrument.

FIG. 9A illustrates a personal computer comprising a body 2001, an image input section 2002, a display section 2003, a keyboard 2004 and so on. The present invention can be applied to the display section 2003.

Figure 9B:
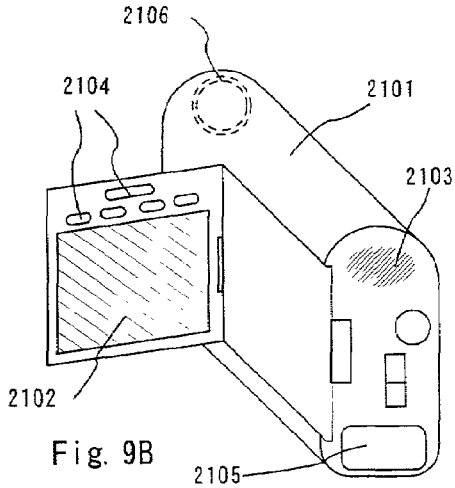

FIG. 9B illustrates a video camera comprising a body 2100, a display section 2102, a voice input section 2103, an operation switch 2104, a battery 2105, an image receiving section 2106 and so on. The present invention can be applied to the display section 2102.

Figure 9C:
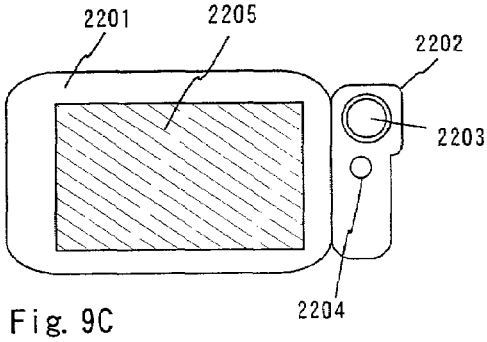

FIG. 9C illustrates a mobile computer comprising a body 2201, a camera section 2202, an image receiving section 2203, an operation switch 2204, a display section 2205 and so on. The present invention can be applied to the display section 2205.

Figure 9D:
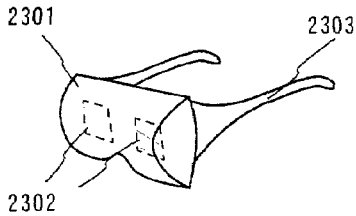

FIG. 9D illustrates a goggle-type display comprising a body 2301, a display section 2302, an arm section 2303 and so on. The present invention can be applied to the display section 2302.

Figure 9E:
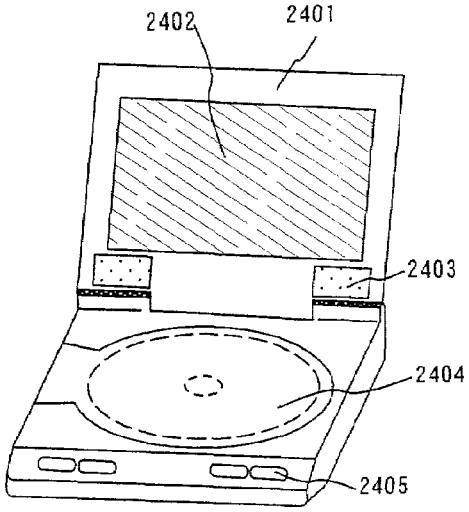

FIG. 9E illustrates a player using a recording medium in which programs are recorded. The player comprises a body 2401, a display section 2402, a speaker section 2403, a recording medium 2404, all operation switch 2405 and so on. According to this player, a digital versatile disc (DVD), a compact disc (CD) or the like is used to appreciate music or movies or make use of games or the Internet. The present invention can be applied to the display section 2402.

Figure 9F:
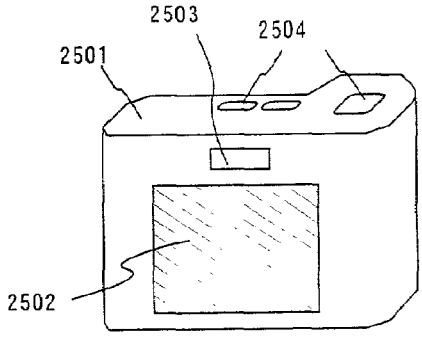

FIG. 9F illustrates a digital camera comprising a body 2501, a display section 2502, an eyepiece section 2503, an operation switch 2504, an image receiving section (not illustrated) and so on. The present invention can be applied to the display section 2502.

Figure 10A:
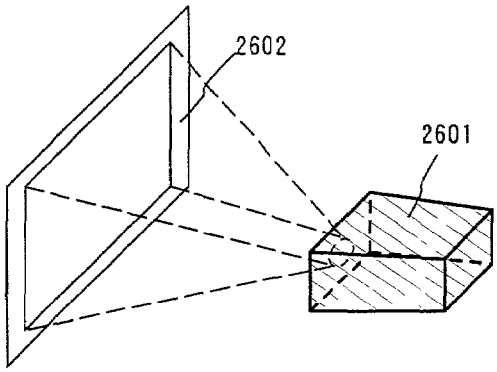
FIGS. 10A to 10D are views illustrating examples of an electronic instrument.

FIG. 10A illustrates a front-type projector comprising a projection unit 2601, a screen 2602 and so on. The present invention can be applied to a liquid crystal module 2808 constituting a part of the projection unit 2601.

Figure 10B:
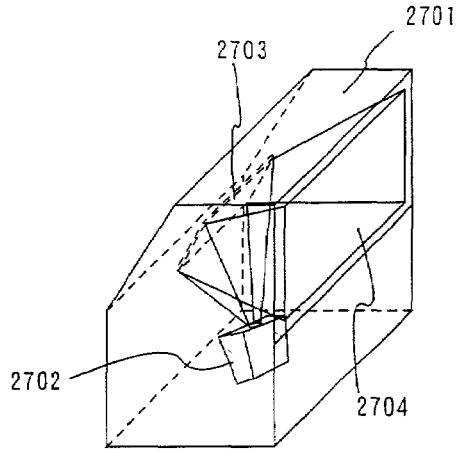

FIG. 10B illustrates a rear-type projector comprising a body 2701, a projection unit 2702, a mirror 2703, a screen 2704 and so on. The present invention can be applied to a liquid crystal module 2808 constituting a part of the projection unit 2702.

Figure 10C:
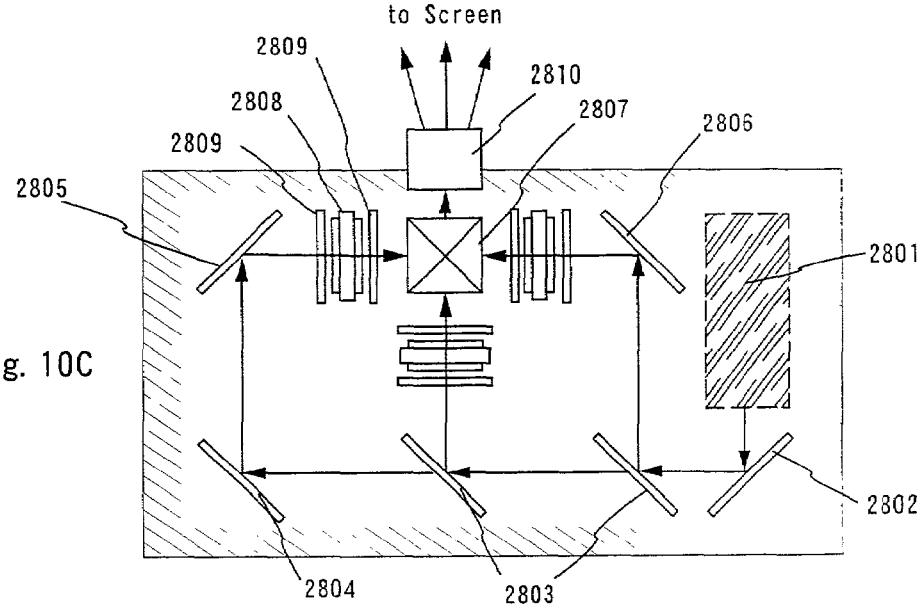

FIG. 10C is a view illustrating an example of the structure of the projection unit 2601 or 2702 in FIG. 10A or FIG. 10B. The projection unit 2601 or 2702 is composed of a light source optical-system 2801, mirrors 2802, 2804 to 2806, a dichroic mirror 2803, a prism 2807, a liquid crystal module 2808, a phase-difference plate 2809, and a projection optical-system 2810. The projection optical-system 2810 is composed of an optical system including a projector lens. The present example is a 3-plate type example. However, the present invention is not limited to this example. For example, a single-plate type may be used. In the optical path shown by arrows in FIG. 10C, an operator may appropriately set up an optical system, for example, an optical lens, a film having a light-polarizing function, a film for adjusting a phase difference, or an IR film.

Figure 10D:
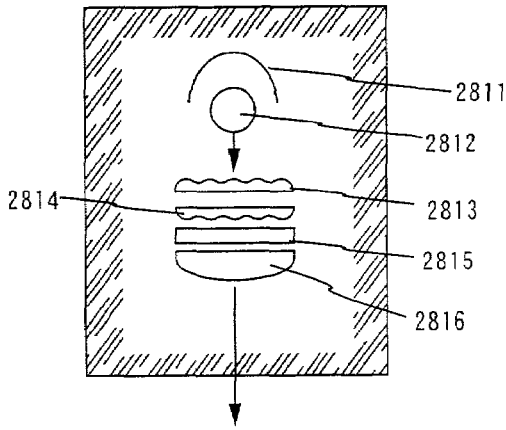

FIG. 10D is a view illustrating an example of the structure of the light source optical-system 2801 in FIG. 10C. In the present example, the light source optical-system 2801 is composed of a reflector 2811, a light source 2812, lens arrays 2813 and 2814, a light polarization converting element 2815, and a condenser lens 2816. The light source optical-system illustrated in FIG. 10D is an example, and is unrestrictive. For example, an operator may appropriately set up an optical system, tor example, an optical lens, a film having a light-polarizing function, a film for adjusting a phase difference, or an IR film.

In the projector illustrated in FIG. 10, the electro-optical device of a transmission type is used. No example wherein the present invention is applied to an electro-optical device of a reflection type is illustrated.

Figure 11A:
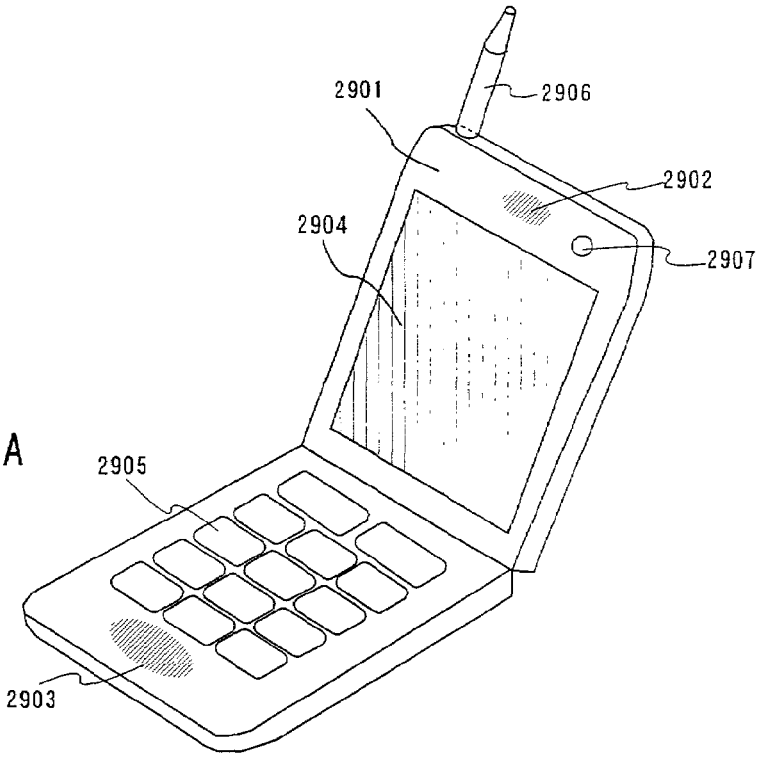
FIGS. 11A to 11C are views illustrating examples of an electronic instrument.

FIG. 11A illustrates a portable telephone comprising a body 2901, a voice output section 2902, a voice input section 2903, a display section 2904, an operation switch 2905, an antenna 2906, an image input section (a CCD, an image sensor or the like) 2907, and so on. The present invention can be applied to the display section 2904.

Figure 11B:
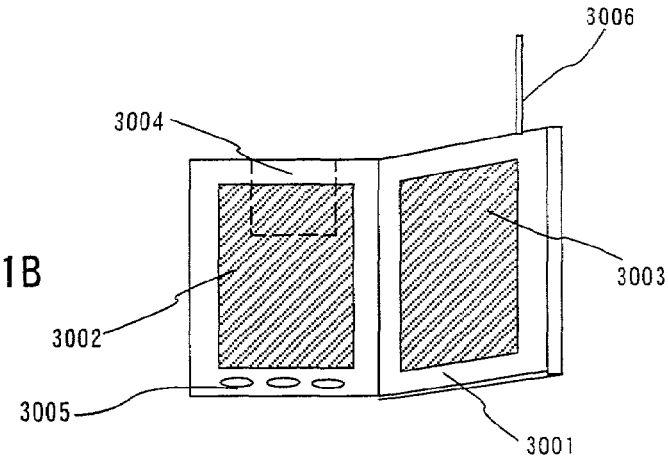

FIG. 11B illustrates a portable book (electronic book) comprising a body 3001, display sections 3002 and 3003, a recording medium 3004, an operation switch 3005, an antenna 3006, and so on. The present invention can be applied to the display sections 3002 and 3003.

Figure 11C:
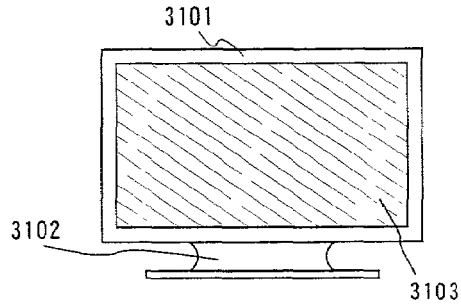
Figure 12:
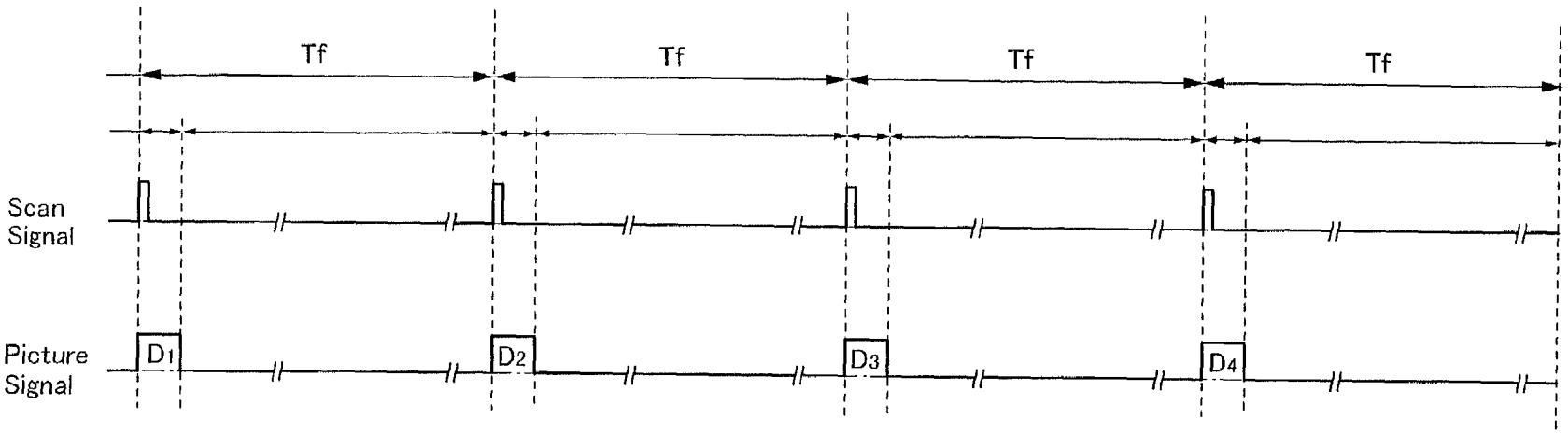
Fig. 12 (Prior Art)
FIG. 12 is a timing chart according to the prior art.

FIG. 11C illustrates a display comprising a body 3101, a supporting base 3102, a display section 3103, and so on. The present invention can be applied to the display section 3103.

As described above, the scope to which the present invention can be applied is very wide, and the present invention can be applied to processes for producing electronic instruments in all fields. The electronic instruments of the present example can be realized even if any combination in Example 1 or Example 2 is used.

According to the present invention, it is possible to realize a liquid crystal display device which can display highly minute pictures wherein flickers and afterimages are reduced. Moreover, according to the driving method of the present invention, superior display can be obtained regardless of the response speed of liquid crystal.

What is claimed is:

1. A method of driving a liquid crystal display device comprising:

supplying picture signals from a digital video data dividing circuit to a D/A converter circuit;

supplying a first voltage for a first gradation from the D/A converter circuit to a pixel by first scanning signals of a gate driver in a first subframe period;

supplying a voltage for a 0th gradation from the D/A converter circuit to the pixel by second scanning signals of the gate driver in a second subframe period after the first subframe period;

supplying a second voltage for a second gradation from the D/A converter circuit to the pixel by third scanning signals of the gate driver in a third subframe period after the second subframe period;

supplying a third voltage for a third gradation from the D/A converter circuit to the pixel by fourth scanning signals of the gate driver in a fourth subframe period after the third subframe period;

displaying a first combined gradation in a first frame period comprising the first subframe period and the second subframe period;

displaying a second combined gradation in a second frame period comprising the third subframe period and the fourth subframe period, and wherein the first subframe period and the second subframe period are adjacent to each other;

wherein the third subframe period and the fourth subframe period are adjacent to each other;

wherein in the first frame period the first combined gradation acknowledged by operator's eye is displayed;

wherein the first combined gradation corresponds to half of the first voltage, wherein in the second frame period the second combined gradation acknowledged by operator's eye is displayed, wherein the second combined gradation corresponds to the second voltage and the third voltage, and wherein the voltage for the 0th gradation is for displaying black-display in a screen of the liquid crystal display device, wherein the second voltage is higher than the third voltage, wherein the first voltage and the second voltage are same voltage, and wherein the 0th gradation voltage is lower than the third voltage.

2. A method of driving a liquid crystal display device comprising:

supplying picture signals from a digital video data dividing circuit to a D/A converter circuit;

supplying voltages of picture signals from the D/A converter circuit to a pixel by scanning signals of a gate driver in each of plural subframe periods; and displaying one frame by displaying plural subframes;

wherein one frame period has the plural subframe periods;

wherein the plural subframe periods are adjacent to each other;

wherein a first voltage for a first gradation is supplied to the pixel in a first subframe period, wherein 0th gradation voltage is supplied to the pixel in a second subframe period after the first subframe period, wherein a second voltage for a second gradation is supplied to the pixel in a third subframe period after the second subframe period, wherein a third voltage for a third gradation is supplied to the pixel in a fourth subframe period after the third subframe period, wherein the second voltage and the third voltage are different from each other throughout displaying the one frame, and wherein the 0th gradation voltage is for displaying black-display in a screen of the liquid crystal display device, wherein the second voltage is higher than the third voltage, wherein the first voltage and the second voltage are same voltage, and wherein the 0th gradation voltage is lower than the third voltage.

3. The method of driving the liquid crystal display device according to any one of claims 1 and 2, wherein the one frame period is 1/60 second.

4. The method of driving the liquid crystal display device according to any one of claims 1 and 2, wherein each of the subframe periods is 1/120 second.

5. The method of driving the liquid crystal display device according to any one of claims 1 and 2, wherein the one frame period is 1/24 second.

6. The method of driving the liquid crystal display device according any one of claims 1 and 2, wherein the one frame period is 1/48 second.

7. The method of driving the liquid crystal display device according to any one of claims 1 and 2, wherein the one frame period is 1/96 second.

8. The method of driving the liquid crystal display device according to any one of claims 1 and 2, wherein the liquid crystal display device is incorporated into an electronic equipment selected from the group consisting of a video camera, a digital camera, a head mount display, a car navigation system, a projector, a car stereo, a personal computer, and portable data terminals.

9. The method of driving the liquid crystal display device according to any one of claims 1 and 2, wherein the digital video data dividing circuit and the D/A converter circuit are formed on the same substrate.

10. The method of driving the liquid crystal display device according to any one of claims 1 and 2, wherein the voltage for the 0th gradation is a reset signal.

11. The method of driving the liquid crystal display device according to any one of claims 1 and 2, wherein the liquid crystal display device displays a low-gradation voltage area, a middle-gradation voltage area, and a high-gradation voltage area in a screen, and wherein a reset signal is supplied to the one of the subframes in the low-gradation voltage area of the picture screen, and no reset signal is supplied to the one of the subframes in areas other than the low-gradation voltage area of the picture screen.

12. A liquid crystal display device comprising:

plural pixels;

a gate driving circuit;

a D/A converter circuit for supplying picture signals to the pixels by scanning signals of the gate driving circuit;

a digital video data dividing circuit for supplying picture signals to the D/A converter circuit;

a liquid crystal whose transmittivity is changed dependently on a voltage of the picture signals supplied to the pixels;

means for supplying voltages of picture signals from the D/A converter circuit to a pixel by scanning signals of a gate driver in each of plural subframe periods;

means for displaying one frame by displaying plural subframes; and means for dividing the one frame to the plural subframes, and dividing picture signals supplied in each of frame periods to picture signals supplied in the plural subframe periods;

wherein one frame period has the plural subframe periods;

wherein the plural subframe periods are adjacent to each other;

wherein the supplied voltages in adjacent subframe periods are different from each other throughout displaying the one frame, wherein a first voltage for a first gradation is supplied to the pixel in a first subframe period, wherein 0th gradation voltage is supplied to the pixel in a second subframe period, wherein a second voltage for a second gradation is supplied to the pixel in a third subframe period, wherein a third voltage for a third gradation is supplied to the pixel in a fourth subframe period, wherein the second voltage and the third voltage are different from each other throughout displaying the one frame, and wherein the 0th gradation voltage is for displaying black-display in a screen of the liquid crystal display device, wherein the second voltage is higher than the third voltage, wherein the first voltage and the second voltage are same voltage, and wherein the 0th gradation voltage is lower than the third voltage.

13. A liquid crystal display device comprising:

plural pixels;

a gate driving circuit;

a D/A converter circuit for supplying picture signals to the pixels by scanning signals of the gate driving circuit;

a digital video data dividing circuit for supplying picture signals to the D/A converter circuit;

a liquid crystal whose transmittivity is changed dependently on the voltage of the picture signals supplied to the pixels;

means for dividing one frame to plural subframes, and dividing picture signals supplied in each of frame periods to picture signals supplied in plural subframe periods;

means for supplying a first voltage for a first gradation from the D/A converter circuit to a pixel by first scanning signals of a gate driver in a first subframe period;

means for supplying a voltage for a 0th gradation to the pixel by second scanning signals of the gate driver in a second subframe period after the first subframe period;

means for supplying a second voltage for a second gradation from the D/A converter circuit to the pixel by third scanning signals of the gate driver in a third subframe period after the second subframe period;

means for supplying a third voltage for a third gradation from the D/A converter circuit to the pixel by fourth scanning signals of the gate driver in a fourth subframe period after the third subframe period;

means for displaying a first combined gradation in a first frame period comprising the first subframe period and the second subframe period;

means for displaying a second combined gradation in a second frame period comprising the third subframe period and the fourth subframe period, and wherein the first subframe period and the second subframe period are adjacent to each other;

wherein the third subframe period and the fourth subframe period are adjacent to each other;

wherein in the first frame period the first combined gradation acknowledged by operator's eye is displayed;

wherein the first combined gradation corresponds to half of the first voltage, wherein in the second frame period the second combined gradation acknowledged by operator's eye is displayed, wherein the second combined gradation corresponds to the second voltage and the third voltage, and wherein the 0th gradation voltage is for displaying black-display in a screen of the liquid crystal display device, wherein the second voltage is higher than the third voltage, wherein the first voltage and the second voltage are same voltage, and wherein the 0th gradation voltage is lower than the third voltage.

14. The liquid crystal display device according to any one of claims 12 and 13, wherein the one frame period is 1/60 second.

15. The liquid crystal display device according to any one of claims 12 and 13, wherein each of the subframe periods is 1/120 second.

16. The liquid crystal display device according to any one of claims 12 and 13, wherein the one frame period is 1/24 second.

17. The liquid crystal display device according any one of claims 12 and 13, wherein the one frame period is 1/48 second.

18. The liquid crystal display device according to any one of claims 12 and 13, wherein the one frame period is 1/96 second.

19. The liquid crystal display device according to any one of claims 12 and 13, wherein the liquid crystal display device is incorporated into an electronic equipment selected from the group consisting of a video camera, a digital camera a head mount display, a car navigation system, a projector, a car stereo, a personal computer, and portable data terminals.

20. The liquid crystal display device according to any one of claims 12 and 13, wherein the digital video data dividing circuit, the D/A converter circuit, the gate driving circuit and plural pixels are formed on the same substrate.

21. The liquid crystal display device according to claim 12, wherein the liquid crystal display device displays a low-gradation voltage area, a middle-gradation voltage area, and a high-gradation voltage area in a screen, and wherein a reset signal is supplied to the one of the subframes in the low-gradation voltage area of the picture screen, and no reset signal is supplied to the one of the subframes in areas other than the low-gradation voltage area of the picture screen.

22. The liquid crystal display device according to claim 13, wherein the liquid crystal display device has a low-gradation voltage area, a middle-gradation voltage area, and a high-gradation voltage area, and wherein a reset signal is supplied to the one of the subframes in the low-gradation voltage area of the picture screen, and no reset signal is supplied to the one of the subframes in areas other than the low-gradation voltage area of the picture screen.

* * * * *